US005594393A

United States Patent [19]

Bischof

[11] Patent Number: 5,594,393

[45] Date of Patent: Jan. 14, 1997

[54] MICROWAVE LINE STRUCTURE

[75] Inventor: Werner Bischof, Backnang, Germany

[73] Assignee: ANT Nachrichtentechnik GmbH, Backnang, Germany

[21] Appl. No.: 423,033

[22] Filed: Apr. 17, 1995

[30] Foreign Application Priority Data

May 21, 1994 [DE] Germany ..... 44 17 976.6

[51] Int. Cl.[6] ..... H01P 5/10

[52] U.S. Cl. ..... 333/26; 333/128; 333/238

[58] Field of Search ..... 333/128, 26, 33, 333/238, 246

[56] References Cited

U.S. PATENT DOCUMENTS 5,025,232 6/1991 Pavio ..... 333/26
5,369,795 11/1994 Yanagimoto ..... 333/26 X

FOREIGN PATENT DOCUMENTS 4032260 4/1992 Germany .

OTHER PUBLICATIONS

Streifenleitungen, Geschwinde, et al, C. F. Winterische Verlagshandlung, 1960, pp. 1–5 No Month.
Lehrbuch der Hochfrequenztechnik, vol. 1, 1973, p. 104 No Month.

*Primary Examiner*—Paul Gensler

[57] ABSTRACT

A microwave line structure which has a first conducting track applied onto a substrate and a second conducting track which extends, supported on posts, at a distance above the first conducting track, a coplanar line being arranged, in addition to the microstrip line formed by the first conducting track and the second conducting track, on the substrate and coupled to this microstrip line, and the microstrip line extending between the two conducting tracks of the coplanar line, wherein, at one end of the coplanar line, the two conducting tracks of the latter are electrically conductingly connected to one another and to the first conducting track, wherein at the other end of the coplanar line the latter is open, wherein the length of the coplanar line is approximately equal to one quarter of the wavelength of the average operating frequency and wherein an asymmetrical line can be coupled to the first conducting track and the second conducting track at the short-circuited end of the coplanar line and a symmetrical two-wire line can be coupled to the open end of the coplanar line. Multi-application balancing circuit in monolithic integrated coplanar microwave technology for above 60 GHz. Use in mixers, modulators, amplifiers, etc. of radio link systems.

9 Claims, 2 Drawing Sheets

MICROWAVE LINE STRUCTURE

BACKGROUND OF THE INVENTION

The present invention relates to a microwave line structure.

More particularly, it relates to a microwave line structure which has a first conducting track applied onto a substrate, a second conducting track supported on posts and extending at a distance above the first conducting track, and a coplanar line arranged on the substrate and coupled to a microstrip line extending between the conducting tracks of a coplanar line.

It is known to use planar lines, for example in the form of microstrips or coplanar lines for circuits in microwave technology. As described, for example, in the book "Streifenleitungen" [Striplines] by Geschwinde and Krank, Winterische Verlagshandlung, 1960, pages 1 to 4, microstrips consist of two planar lines applied onto opposite sides of a substrate. Coplanar lines have two or three lines extending next to one another on one substrate side. A microwave line structure as described at the outset, is described in German Patent Specification 40 32 260. In this case a microstrip line is arranged between the two conducting tracks of a coplanar line.

In radio-frequency technology, the transition from an asymmetrical line, for example a coaxial line, to a symmetrical line, for example a two-wire line, is effected using a balancing element which is also referred to in the technical literature by the name balun. Exemplary embodiments for such balancing elements are specified in the book Zinke, Brunswick: "Lehrbuch der Hochfrequenztechnik" [Textbook on Radio-Frequency Technology] Volume 1, page 104.

In microwave technology, increasing use is being made of integrated circuits, so-called monolithic microwave integrated circuits MMIC.

SUMMARY OF THE INVENTION

The object of the present invention is to specify a microwave line structure of the type mentioned at the outset which makes it possible to produce a balancing circuit for monolithic integrated circuits in planar form and to use it in a wide frequency range.

In keeping with these objects and with others which will become apparent hereinafter, one feature of the present invention resides, briefly stated, in a microwave line structure which has a first conducting track applied onto a substrate and a second conducting track which extends, supported on posts, at a distance above the first conducting track, a coplanar line being arranged, in addition to the microstrip line formed by the first conducting track and the second conducting track, on the substrate and coupled to this microstrip line, and the microstrip line extending between the two conducting tracks of the coplanar line, wherein, at the one end of the coplanar line, the two conducting tracks of the latter are electrically conductingly connected to one another and to the first conducting track, wherein at the other end of the coplanar line the latter is open, wherein the length of the coplanar line is approximately equal to one quarter of the wavelength of the average operating frequency and wherein an asymmetrical line can be coupled to the first conducting track and the second conducting track at the short-circuited end of the coplanar line and a symmetrical two-wire line can be coupled to the open end of the coplanar line.

In accordance with an additional feature of the present invention at the one end of the coplanar line, both conducting tracks of the latter are electrically conductingly connected to one another and to the first conducting track, wherein, at the other end of the coplanar line, both conducting tracks of the latter are electrically conductingly connected to one another and to the first conducting track, wherein the length of the coplanar line is approximately equal to half the wavelength of the average operating frequency, wherein the first conducting track is interrupted approximately in the middle, wherein the second conducting track extends only above the interruption point of the first conducting track or is extended until it is above the interruption point of the first conducting track and is there connected to the end of the interrupted disconnected part of the first conducting track, and wherein an asymmetrical two-wire line can be coupled to the first conducting track and the second conducting track at the short-circuited end of the coplanar line and a symmetrical two-wire line can be coupled to the interruption point of the first conducting track.

The microwave line structure according to the invention allows a balancing transition from an asymmetrical line type, for example microstrip line, coplanar line, to a symmetrical line type, for example two-wire line, or to two asymmetrical lines having push-pull excitation or in reversed operation mode, actually using a planar circuit technique suitable for monolithic integration. The solution according to the first mentioned embodiment allows a relatively large operating-frequency bandwidth, and the solution of the second embodiment further allows a substantially broadened bandwidth, for example from 5 to 75 GHz.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
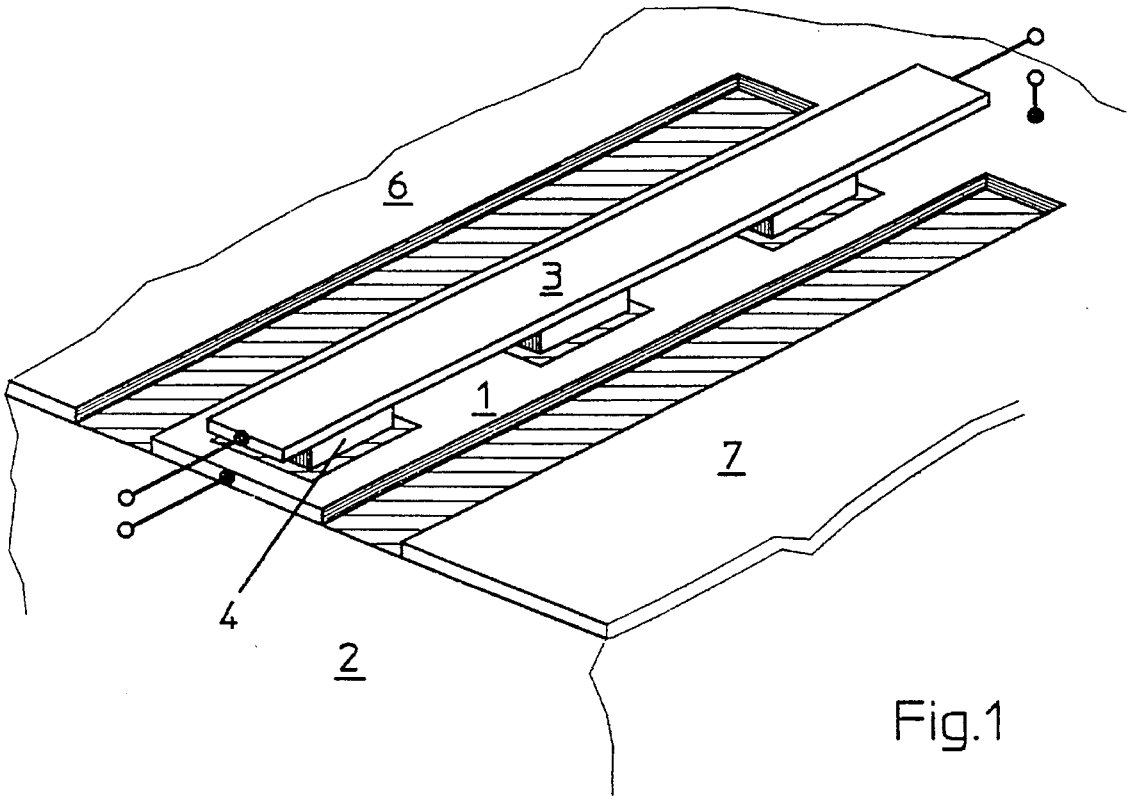
FIG. 1 shows a perspective representation of a microstrip line.
Figure 2:
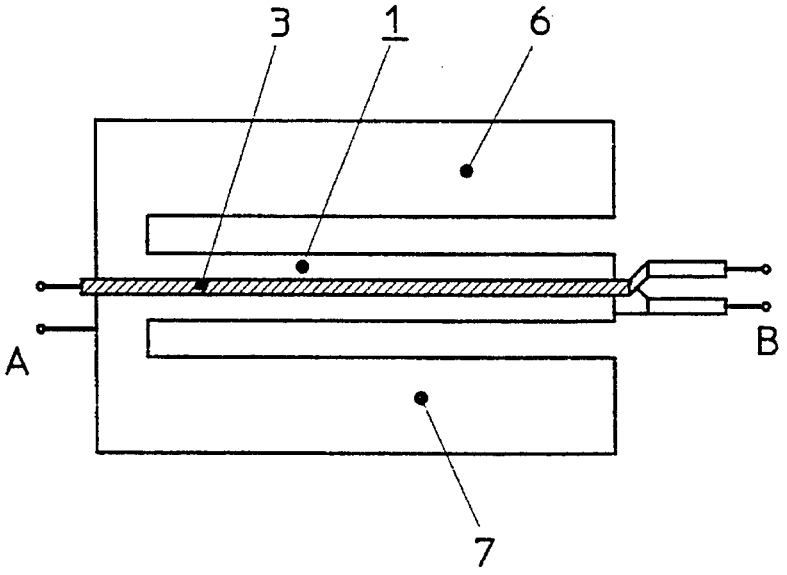
FIG. 2 is a plan view of an arrangement according to the first embodiment.

FIG. 1 shows a microstrip line which has a first conducting track 1 which is metallized onto one side of a substrate 2. Preferably semiconductor materials such as gallium arsenide, indium phosphide or silicon and also ceramic or quartz glass may be used as the substrate. A second track 3, belonging to the microstrip line, is run through at a distance above the track 1 located on the substrate. Posts 4 which project from the track 1 metalized onto the substrate 2 maintain the separation between the two tracks 1 and 3 and act as supports for the track 3. The posts 4 supporting the track 3 are arranged sequentially at suitable separations, so that the space between the two tracks 1 and 3 is mainly filled with air. Under these conditions, it is possible to produce a 50 ohm microstrip track, in which the track 3 guided over the posts 4 need not be designed with such a small dimension, so that adequate coupling conditions can be achieved between this track and other tracks metallized onto the substrate. The posts 4 consist either of a dielectric material or of a conducting material. In the latter case it is necessary for them to be insulated from the metallized conducting track 1 on the substrate 2. As shown in the exemplary embodiment of FIG. 1, recesses 5 are provided in the conducting track 1 for this case. A coplanar line, extending on both sides of the microstrip line and having the two conducting tracks 6 and 7, which are likewise metallized onto the substrate 2, can further be seen. This close spatial arrangement produces coupling between two different line types, namely the microstrip line and the coplanar line. This coupled line arrangement is the basic component of the present balancing circuit. The conducting tracks 1, 3 carry an electromagnetic wave which is supplied to its single-ended input terminal pair A (FIG. 2). At this input terminal pair A, the two conducting tracks 6 and 7 of the coplanar line are connected to one another and to the first conductor of the microstrip line. The length of the coplanar line is approximately ¼ of the wavelength of the operating frequency. Since it is open at the other end, this is a short-circuited coplanar stub which, in the case of $\lambda/4$ resonance, at the other end forms an open circuit, so that return currents are prevented on the first conductor 1. This first track 1 is therefore floating at the terminal pair B.

This means that a floating load, and in particular a balanced two-wire line, can be connected to this symmetrical terminal pair B.

Figure 3:
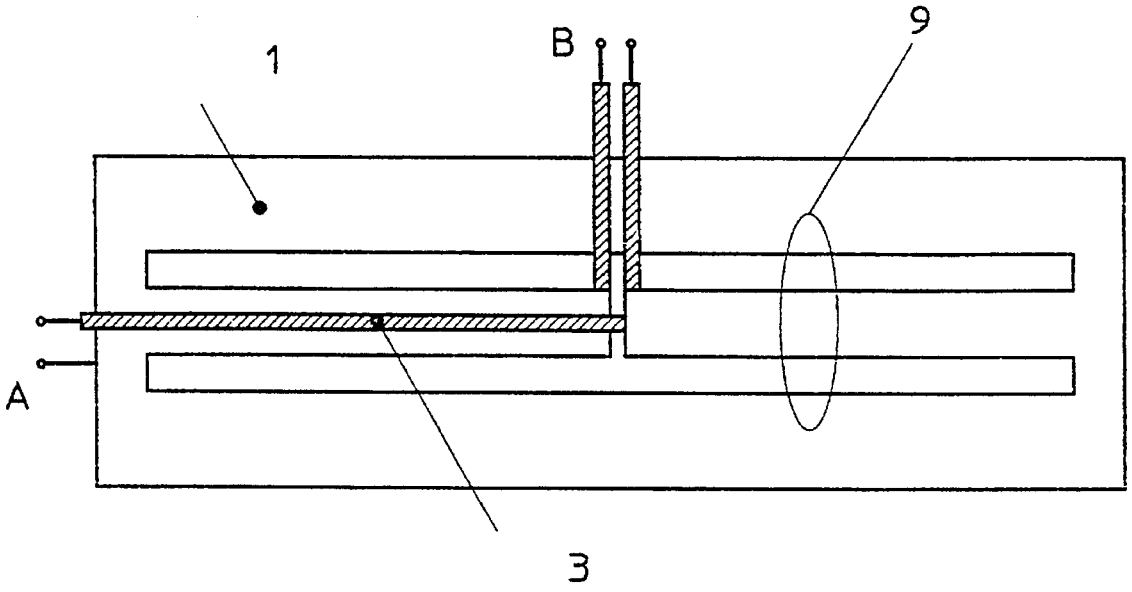
FIG. 3 is a plan view of an arrangement according to the second embodiment.

The reactance of the coplanar stub impairs the behavior of the arrangement away from the resonant frequency. It is possible to compensate for the reactance profile over a large frequency range by using another coplanar stub 9 according to FIG. 3. As shown by FIG. 3, the track 1 is interrupted approximately in the middle and there is led out at its two ends a symmetrical line to terminal pair B. If the two balanced conductors at the terminal pair B are directly connected to two asymmetrical lines, then two outputs with push-pull signals are obtained. In this case the phase difference remains almost exactly 180° over a very wide frequency range.

The arrangement according to the invention can, of course, also be used reciprocally and can thus be used as power splitters or power combiners.

The geometry of the conducting tracks 1, 3 can be dimensioned in a different way according to the requirements, so that, in addition, an impedance conversion between the terminal pairs A and B results.

It is clear that at least two metallization planes must be governed by the monolithic production process, in order to make it possible to produce circuit arrangements according to the invention. It is of further advantage that active circuit elements can also be monolithically integrated compactly on the semiconductor substrate of the balancing circuit according to the invention.

It will be understood that each of the elements described above, or two or more together, may also find a useful application in other types of constructions differing from the types described above.

While the invention has been illustrated and described as embodied in a microwave line structure, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A microwave line structure, comprising a substrate; a first conducting track applied on said substrate; a second conducting track supported on posts and extending at a distance above said first conducting track so that said first conducting track and said second conducting track together form a microstrip line; a coplanar line arranged in addition to said microstrip line on said substrate and coupled to said microstrip line, said coplanar line having two further conducting tracks formed so that said microstrip line extends between said two further conducting tracks, said two further conducting tracks being electrically conductingly short-circuited to one another and to said first conducting track at one end of said coplanar line, while said coplanar line being open at the other end, said coplanar line having a length which is approximately equal to one quarter of a wavelength of an average operating frequency; an asymmetrical line coupleable to said first conducting track and said second conducting track at said short-circuited end of said coplanar line; and a symmetrical two-wire line coupleable to said open end of said coplanar line.

2. A microwave line structure as defined in claim 1, wherein at said other end of said coplanar line, both said further conducting tracks are electrically conductingly connected to one another and to said first conducting track, said coplanar line being formed so that it has a length which is approximately equal to half a wavelength of an average operating frequency, said first conducting track being interrupted in an interruption point located substantially in a middle of said first conducting track, said second conducting track extending only above said interruption point of said first conducting track and is there connected to an end of an interrupted disconnected part of said first conducting track, said asymmetrical line is a two-wire line which is coupled to said first conducting track and said second conducting track at said short-circuited end of said coplanar line, said symmetrical line being a two-wire line coupled to said interruption point of said first conducting track.

3. A microwave line structure as defined in claim 1, wherein at said other end of said coplanar line, both said further conducting tracks are electrically conductingly connected to one another and to said first conducting track, said coplanar line being formed so that it has a length which is approximately equal to half a wavelength of an average operating frequency, said first conducting track being interrupted in an interruption point located substantially in a middle of said first conducting track, said second conducting track extending until it is above said interruption point of said first conducting track and is there connected to an end of an interrupted disconnected part of said first conducting track, said asymmetrical line is a two-wire line which is coupled to said first conducting track and said second conducting track at said short-circuited end of said coplanar line, said symmetrical line being a two-wire line coupled to said interruption point of said first conducting track.

4. A microwave line structure as defined in claim 1, wherein said first and second conductor tracks have a wave impedance which matches a wave impedance of said coplanar line.

5. A microwave line structure as defined in claim 1, wherein said first conducting track has recesses, said posts being composed of conducting material and standing on said substrate in said recesses.

6. A microwave line structure, comprising a substrate; a first conducting track applied on said substrate; a second conducting track supported on posts and extending at a distance above said first conducting track so that said first conducting track and said second conducting track together form a microstrip line; a coplanar line arranged in addition to said microstrip line on said substrate and coupled to said microstrip line, said coplanar line having two further conducting tracks formed so that said microstrip line extends between said two further conducting tracks, said two further conducting tracks being electrically conductingly short-circuit to one another and to said first conducting track at one end of said coplanar line, while said coplanar line being open at the other end, said coplanar line having a length which is approximately equal to one quarter of a wavelength of an average operating frequency; an asymmetrical line coupleable to said first conducting track and said second conducting track at said short-circuited end of said coplanar line; and a symmetrical two-wire line coupleable to said open end of said coplanar line at said other end of said coplanar line, both said further conducting tracks being electrically conductingly connected to one another and to said first track, said coplanar line being formed so that it has a length which is approximately equal to half a wavelength of an average operating frequency, said first conducting track being interrupted in an interruption point located substantially in a middle of said first conducting track, said second conducting track extending only above said interruption point of said first conducting track and is there connected to an end of an interrupted disconnected part of said first conducting track, said symmetrical line is a two-wire line which is coupled to said first conducting track and said second conducting track at said short-circuited end of said coplanar line, said symmetrical line being a two-wire line coupled to said interruption point of said first conducting track, said first conducting track and said second conducting track being connected at said interruption point of said first conductor track, while the other conductor is in conducting connection with one of said conducting tracks of said coplanar line.

7. A microwave line structure, comprising a substrate; a first conducting track applied on said substrate; a second conducting track supported on posts and extending at a distance above said first conducting track so that said first conducting track and said second conducting track together form a microstrip line; a coplanar line arranged in addition to said microstrip line on said substrate and coupled to said microstrip line, said coplanar line having two further conducting tracks formed so that said microstrip line extends between said two further conducting tracks, said two further conducting tracks being electrically conductingly short-circuit to one another and to said first conducting track at one end of said coplanar line, while said coplanar line being open at the other end, said coplanar line having a length which is approximately equal to one quarter of a wavelength of an average operating frequency; an asymmetrical line coupleable to said first conducting track and said second conducting track at said short-circuited end of said coplanar line; and a symmetrical two-wire line coupleable to said open end of said coplanar line, said first and second conducting tracks of said strip line having a width dimensioned differently as to their profile, so that impedance conversion takes place.

8. A microwave line structure, comprising a substrate; a first conducting track applied on said substrate; a second conducting track supported on posts and extending at a distance above said first conducting track so that said first conducting track and said second conducting track together form a microstrip line; a coplanar line arranged in addition to said microstrip line on said substrate and coupled to said microstrip line, said coplanar line having two further conducting tracks formed so that said microstrip line extends between said two further conducting tracks, said two further conducting tracks being electrically conductingly short-circuit to one another and to said first conducting track at one end of said coplanar line, while said coplanar line being open at the other end, said coplanar line having a length which is approximately equal to one quarter of a wavelength of an average operating frequency; an asymmetrical line coupleable to said first conducting track and said second conducting track at said short-circuited end of said coplanar line; and a symmetrical two-wire line coupleable to said open end of said coplanar line, said first and second conducting tracks of said strip line having a separation dimensioned differently as to their profile, so that impedance conversion takes place.

9. A microwave line structure, comprising a substrate; a first conducting track applied on said substrate; a second conducting track supported on posts and extending at a distance above said first conducting track so that said first conducting track and said second conducting track together form a microstrip line; a coplanar line arranged in addition to said microstrip line on said substrate and coupled to said microstrip line, said coplanar line having two further conducting tracks formed so that said microstrip line extends between said two further conducting tracks, said two further conducting tracks being electrically conductingly short-circuit to one another and to said first conducting track at one end of said coplanar line, while said coplanar line being open at the other end, said coplanar line having a length which is approximately equal to one quarter of a wavelength of an average operating frequency; an asymmetrical line coupleable to said first conducting track and said second conducting track at said short-circuited end of said coplanar line; and a symmetrical two-wire line coupleable to said open end of said coplanar line, said first and second conducting tracks of said strip line having a dielectric dimensioned differently as to their profile, so that impedance conversion takes place.

* * * * *